US008145118B2

(12) United States Patent
Seto

(10) Patent No.: US 8,145,118 B2
(45) Date of Patent: Mar. 27, 2012

(54) IMAGE-FORMING SYSTEM, PAPER CURL CORRECTION APPARATUS, IMAGE-FORMING APPARATUS, POST-PROCESSING APPARATUS, AND COMPUTER-READABLE MEDIUM FOR CONTROLLING PAPER CURL CORRECTION

(75) Inventor: Tsuyoshi Seto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 830 days.

(21) Appl. No.: 11/876,946

(22) Filed: Oct. 23, 2007

(65) Prior Publication Data

US 2008/0219734 A1 Sep. 11, 2008

(30) Foreign Application Priority Data

Mar. 9, 2007 (JP) ..... 2007-060217

(51) Int. Cl.
*G03G 15/00* (2006.01)

(52) U.S. Cl. ..... 399/406; 399/407; 271/188; 271/209

(58) Field of Classification Search ..... 399/406, 399/407–410; 271/161, 188, 209
See application file for complete search history.

(56) References Cited

U.S. PATENT DOCUMENTS 5,933,698 A * 8/1999 Muramatsu ..... 399/406
7,569,011 B2 * 8/2009 Matsumoto ..... 493/459
7,576,873 B2 * 8/2009 Kurohata et al. ..... 358/1.13
7,653,340 B2 * 1/2010 Shida et al. ..... 399/406
2005/0063747 A1 3/2005 Ushio
2006/0120782 A1 * 6/2006 Nakamura et al. ..... 399/405

FOREIGN PATENT DOCUMENTS

JP 6144678 5/1994
JP 2001213563 A 8/2001
JP 2005096892 4/2005

OTHER PUBLICATIONS

Japanese Grounds for Rejection mailed on Oct. 4, 2011 in connection with corresponding JP Application No. 2007-060217 and English translation thereof.

* cited by examiner

*Primary Examiner* — Matthew G Marini
(74) *Attorney, Agent, or Firm* — Gesmer Updegrove LLP

(57) ABSTRACT

There is provided a paper curl correction apparatus including: an input curl determining unit that determines, on the basis of curl characteristic information of a first apparatus which processes a sheet, input curl information corresponding to an amount of curl of a sheet input from the first apparatus; a target curl acquiring unit that acquires, from a post-processing apparatus which performs a post process on a sheet, target curl information suited for the post process; a correction determining unit that determines, on the basis of the input curl information and the target curl information, an amount of curl correction for correcting an amount of curl of the sheet input from the first apparatus to an amount of curl suited for the post process; and a curl correcting unit that corrects the curl of the sheet input from the first apparatus in accordance with the amount of curl correction.

15 Claims, 10 Drawing Sheets

314

DETERMINATION INFORMATION FOR DETERMINING AMOUNT OF TARGET CURL OF POST-PROCESSING MECHANISM

| PAPER QUALITY | AMOUNT OF TARGET CURL |
|---|---|
| THIN PAPER | −2 |
| ORDINARY PAPER | −1 |
| PAPERBOARD 1 | −1 |
| PAPERBOARD 2 | 0 |
| ..... | ..... |

| AMOUNT OF CURL C | | CURL CORRECTION LEVEL | |
|---|---|---|---|
| DIRECTION | AMOUNT[mm] | DIRECTION | LEVEL |
| UPWARD(+) | C≧10 | DOWNWARD(-) | 10 |
| UPWARD | 10>C≧9 | DOWNWARD | 9 |
| UPWARD | 9>C≧8 | DOWNWARD | 8 |
| UPWARD | 8>C≧7 | DOWNWARD | 7 |
| ... | ... | ... | ... |
| UPWARD | 3>C≧2 | DOWNWARD | 2 |
| UPWARD | 2>C≧1 | DOWNWARD | 1 |
| — | 1>C | — | 0 |
| DOWNWARD | 2>C≧1 | UPWARD | 1 |
| DOWNWARD | 3>C≧2 | UPWARD | 2 |
| ... | ... | ... | ... |
| DOWNWARD | 8>C≧7 | UPWARD | 7 |
| DOWNWARD | 9>C≧8 | UPWARD | 8 |
| DOWNWARD | 10>C≧9 | UPWARD | 9 |
| DOWNWARD | C≧10 | UPWARD | 10 |

Fig. 6

DETERMINATION INFORMATION FOR DETERMINING AMOUNT OF TARGET CURL OF POST-PROCESSING MECHANISM

314a

| PAPER QUALITY | AMOUNT OF TARGET CURL |
|---|---|
| THIN PAPER | −2 |
| ORDINARY PAPER | −1 |
| PAPERBOARD 1 | −1 |
| PAPERBOARD 2 | 0 |
| ..... | ..... |

DETERMINATION INFORMATION FOR DETERMINING AMOUNT OF CURL OF BYPASS ROUTE

314b

| PAPER QUALITY | AMOUNT OF CURL |
|---|---|
| THIN PAPER | 0 |
| ORDINARY PAPER | −1 |
| PAPERBOARD 1 | −1 |
| PAPERBOARD 2 | −2 |
| ..... | ..... |

Fig. 9

| PAPER QUALITY | AMOUNT OF TARGET CURL |
|---|---|
| THIN PAPER | −2 |
| ORDINARY PAPER | −1 |
| PAPERBOARD 1 | −1 |
| PAPERBOARD 2 | 0 |
| ..... | ..... |

| PAPER QUALITY | AMOUNT OF CURL |
|---|---|
| THIN PAPER | 0 |
| ORDINARY PAPER | −1 |
| PAPERBOARD 1 | −1 |
| PAPERBOARD 2 | −2 |
| ..... | ..... |

| PAPER QUALITY | AMOUNT OF CURL |
|---|---|
| THIN PAPER | 0 |
| ORDINARY PAPER | 0 |
| PAPERBOARD 1 | 0 |
| PAPERBOARD 2 | 0 |
| ..... | ..... |

IMAGE-FORMING SYSTEM, PAPER CURL CORRECTION APPARATUS, IMAGE-FORMING APPARATUS, POST-PROCESSING APPARATUS, AND COMPUTER-READABLE MEDIUM FOR CONTROLLING PAPER CURL CORRECTION

CROSS-REFERENCE TO RELATED APPLICATIONS

This application is based on and claims priority under 35 USC 119 from Japanese Patent Application No. 2007-060217 filed on Mar. 9, 2007.

BACKGROUND

1. Technical Field

The present invention relates to an image-forming system, a paper curl correction apparatus, an image-forming apparatus, a post-processing apparatus, and a computer-readable medium for controlling paper curl correction.

2. Related Art

There are known post-processing apparatuses which perform a post process such as stapling, binding, and stacking on a sheet which is output from an image-forming apparatus such as a printer or a copier.

As is well known, a curl arises on a sheet as a result of a process such as fusing in an image-forming apparatus. In recent years, due to an increase in variation of paper types or the like, various types of curling arise on sheets. The manner of curl of the sheet which is input to the post-processing apparatus may adversely affect the quality of the post process. In consideration of this, in the related art, the curl of the sheet which is output from the image-forming apparatus is corrected with a paper curl correction apparatus (also known as a decurler) and the sheet is then input to the post-processing apparatus.

The post-processing apparatuses include various types, such as a stapling apparatus and a stacker. In some of these various post-processing apparatuses, quality may be improved when the input printed sheet is appropriately curled. The optimum manner of curl of the input paper depends on the post-processing apparatus.

Because the variations of the post-processing apparatuses are increasing, it may be impossible to know in advance what type of a post-processing apparatus will be connected downstream of the paper curl correction apparatus. The paper curl correction apparatus can apply a paper curl correction suitable for the post-processing apparatus if the characteristics of the post-processing apparatus are known, but cannot handle a post-processing apparatus having unknown characteristics. Meanwhile, if the characteristics of all post-processing apparatuses which can be connected are to be stored in the paper curl correction apparatus in advance, the necessary storage capacity would be enormous. In addition, when a new post-processing apparatus is developed, information of the characteristics of the new post-processing apparatus must be manually registered in the paper curl correction apparatus, which is complicated.

SUMMARY

According to one aspect of the present invention, there is provided an image-forming system having an image-forming apparatus, a paper curl correction apparatus that corrects a curl of a sheet which is input from the image-forming apparatus, and one or more post-processing apparatuses provided downstream of the paper curl correction apparatus, wherein each of the post-processing apparatuses has one or more post-processing units that perform a post process on a sheet, and a first provision unit that provides to the paper curl correction apparatus, for each of the one or more post-processing units, target curl information for determining an amount of curl of a sheet suited for the post-processing unit, and the paper curl correction apparatus has an input curl determining unit that determines, from curl characteristic information of the image-forming apparatus, input curl information corresponding to an amount of curl of a sheet which is input from the image-forming apparatus, a correction determining unit that determines, from input curl information determined by the input curl determining unit and target curl information corresponding to a post-processing unit to be used among the one or more post-processing units of the one or more post-processing apparatuses, an amount of curl correction for correcting an amount of curl of the sheet which is input from the image-forming apparatus to an amount of curl suited for the post-processing unit to be used, and a curl-correcting unit that corrects a curl of a sheet which is input from the image-forming apparatus in accordance with an amount of curl correction determined by the correction determining unit.

BRIEF DESCRIPTION OF THE DRAWINGS

Exemplary embodiment(s) of the present invention will be described in detail by reference to the following figures, wherein:

FIG. 6 is a diagram schematically showing an example of determination information for determining a curl correction level;

FIG. 9 is a diagram showing an example of determination information held by a post-processing apparatus;

DETAILED DESCRIPTION

Figure 1:
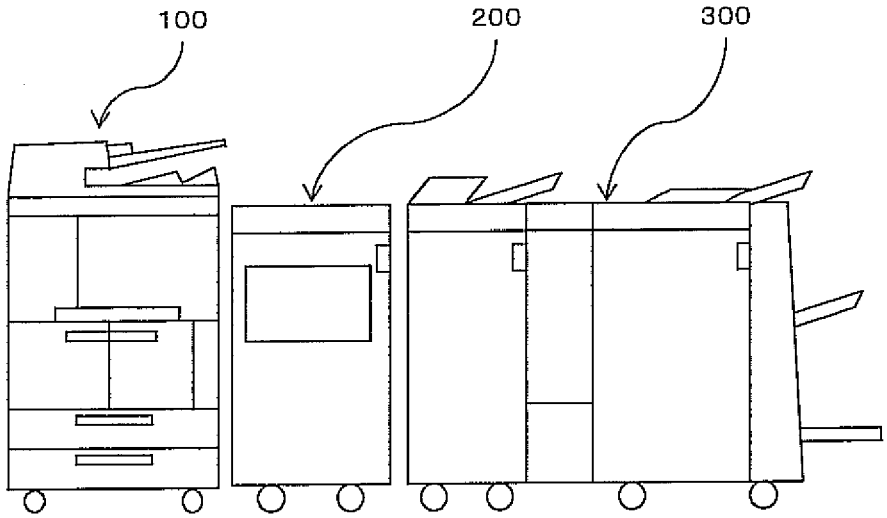
FIG. 1 is a side view of an example image-forming system having a post-processing apparatus.

FIG. 1 shows an example of an image-forming system. The image-forming system of FIG. 1 has an image-forming apparatus 100, a curl correction apparatus 200, and a post-processing apparatus 300, connected in this order.

The image-forming apparatus 100 is an apparatus having a function to print an image on a sheet-like medium such as paper (hereinafter simply referred to as "sheet"). The image-forming apparatus 100 is, for example, a printer, a digital copier, or a digital multifunction device (an apparatus having multiple functions of a printer, a copier, a scanner, etc.). A print mechanism of the image-forming apparatus 100 is typically an electrophotography or xerography print mechanism, but may be of other systems such as an inkjet. A printed sheet which is output from the image-forming apparatus 100 is input to the curl correction apparatus 200.

The curl correction apparatus 200 corrects curl of the printed sheet which is output from the image-forming apparatus 100. The sheet having the curl corrected and which is output from the curl correction apparatus 200 is input to the post-processing apparatus 300.

The post-processing apparatus 300 is an apparatus which performs a post process on a printed sheet. Post processes include various processes such as stapling, punching, folding, binding, stacking, etc. The post-processing apparatuses 300 are given different names depending on the functions to be provided by the apparatuses, such as a stapler for a post-processing apparatus which staples and a stacker for an apparatus which stacks a large amount of printed sheets. There also is a multifunctional post-processing apparatus which provides multiple post-processing functions in a single device.

Figure 2:
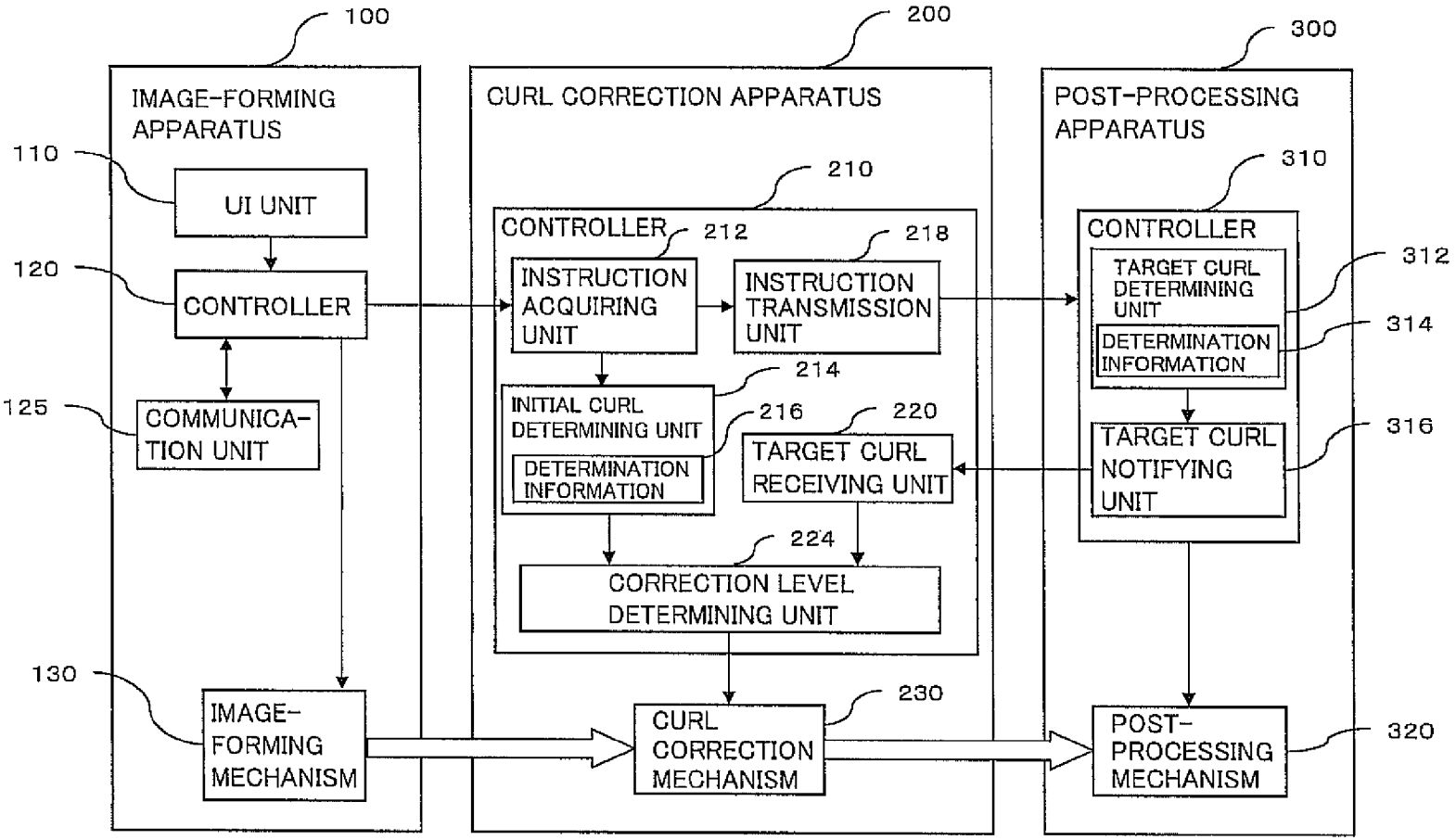
FIG. 2 is a diagram showing an example functional structure of an image-forming system according to an exemplary embodiment of the present invention.

An example functional structure of the image-forming system will now be described with reference to FIG. 2.

The image-forming apparatus 100 has a UI (user interface) unit 110, a controller 120, a communication unit 125, and an image-forming mechanism 130.

The UI unit 110 is a unit which accepts an input of an operation from a user of the image-forming system. The UI unit 110 has a display screen on which an operation guide and other information are displayed, and an input device for accepting an input from the user such as a keypad or operation buttons. The UI unit 110 may alternatively include a device in which the display screen and the input device are integrated, such as a liquid crystal touch panel. The UI unit 110 provides a user interface screen for designating, for example, a type of process to be executed by the image-forming apparatus 100 (for example, printing or copying) and parameters for the process (for example, a number of copies). The UI unit 110 also provides a user interface screen to allow designation of whether or not a post-processing apparatus 300 is to execute the post process or type, and process parameters for the post process to be executed by the post-processing apparatus 300.

The controller 120 is a unit which controls an overall operation of the image-forming apparatus 100. The controller 120 controls the UI unit 110, the communication unit 125 (to be described later), and the image-forming mechanism 130 (to be described later).

In addition, the controller 120 transmits information which forms a basis for determining a curl correction level to the curl correction apparatus 200. The information includes, for example, information related to the sheet such as the paper quality and sheet size. In addition, the degree of curl of the sheet occurring in the image-forming mechanism 130 may differ depending on the image type, such as color or black-and-white, or an area coverage on the sheet occupied by the image. In such a case, information related to the image such as the type of color or black-and-white and the area coverage of the image is also transmitted to the curl correction apparatus as information forming a basis for determination. In addition, environmental information such as temperature and humidity in the image-forming apparatus 100 is also such information which serves as a basis for determination. The information exemplified herein is merely exemplary, and the controller 120 does not need to provide all of these types of information to the curl correction apparatus 200, or may provide information other than these types of information to the curl correction apparatus.

The controller 120 also transmits to the post-processing apparatus 300 information related to an instruction of the post process. The instruction related to the post process includes, for example, parameters of the post process. For example, when a post-processing mechanism 320 is a stapler, the parameters of the post process include size and orientation of the sheet, and the position to be stapled. When the post-processing apparatus 300 has multiple post-processing mechanisms 320, the instruction related to the post process includes information indicating which of the multiple post-processing mechanisms 320 is to be used. When multiple post-processing apparatuses 300 are provided within the image-forming system, the instruction related to the post process includes information for identifying which of the multiple post-processing apparatuses 300 is to be used for the post process.

In the illustrated example, instruction information including both information related to the curl correction apparatus 200 and the instruction for the post-processing apparatus 300 is transmitted from the controller 120 to the curl correction apparatus 200, and further, from the curl correction apparatus 200 to the post-processing apparatus 300. This configuration, however, is merely exemplary. When the image-forming apparatus 100, the curl correction apparatus 200, and the post-processing apparatus 300 are connected to a common data communication network, the controller 120 of the image-forming apparatus 100 may transmit the information related to the post process directly to the post-processing apparatus 300 via the data communication network.

The controller 120 is realized, for example, with a processor such as a CPU executing a control program stored in a storage device (not shown). Alternatively, it is also possible to realize a part of the processes for the control with a hardware circuit such as an ASIC (Application Specific Integrated Circuit).

The communication unit 125 is a unit which communicates with other devices through a data communication network such as a LAN (Local Area Network). For example, a network interface card and various communication protocols may be used. The image-forming apparatus 100 receives instructions from the other devices by means of the communication unit 125. The instructions from the other devices may include, for example, a type of a process to be executed by the image-forming apparatus 100 and process parameters of the process, and a type and process parameters for the post process. The instruction may include document data (described in, for example, a page description language) which is the target of the process such as printing.

The image-forming mechanism 130 is a mechanism for printing an image on a sheet. In electrophotography, the image-forming mechanism 130 includes a photoconductor drum, an exposure unit, a developer unit, an image transfer mechanism, a fuser unit, and a paper-path mechanism.

The post-processing apparatus 300 will now be described. The post-processing apparatus 300 has a controller 310 and the post-processing mechanism 320. The post-processing mechanism 320 is a mechanism which performs a post process on a printed sheet which is output from the image-forming apparatus 100. For example, when the post-processing apparatus 300 is an apparatus for binding, the post-processing mechanism 320 executes a mechanical process for binding the input sheets. Although only one post-processing mechanism 320 is shown in the drawings, the post-processing apparatus 300 may include multiple post-processing mechanisms 320, and the multiple post-processing mechanisms 320 may provide the same or different post-processing functionalities.

The controller 310 is a unit which controls an overall operation of the post-processing apparatus 300. The controller 310 is realized, for example, by a processor such as a CPU executing a control program stored in a storage device (not shown) Alternatively, it is also possible to realize a part of the process for the control using a hardware circuit such as an ASIC.

The controller 310 receives an instruction related to the post process and executes a process for control in accordance with the instruction. In the illustrated example, instruction information including the instruction related to the post process is acquired from an instruction transmission unit 218 of the curl correction apparatus 200. This configuration, however, is merely exemplary. If there is a communication route for direct communication of information between the image-forming apparatus 100 and the post-processing apparatus 300 (bypassing the curl correction apparatus 200), the instruction related to the post process may be transmitted directly from the image-forming apparatus 100 to the post-processing apparatus 300 through the communication route.

The controller 310 executes a process to determine an amount of target curl and notify the amount of target curl to the curl correction apparatus 200, and a process to control the post-processing mechanism 320. Of these, the control of the post-processing mechanism 320 may be similar to that in the related art, and, thus, will not be described in detail. A process regarding the amount of target curl will next be described.

As structures related to the amount of target curl, the controller 310 includes a target curl determining unit 312 and a target curl notifying unit 316. The target curl determining unit 312 determines an amount of target curl of the sheet which is input to the post-processing mechanism 320. The amount of target curl is an amount of curl of the sheet which is suited for the post process of the post-processing mechanism 320. In other words, when the amount of curl of the sheet which is input to the post-processing mechanism 320 is at the amount of target curl, the post process by the post-processing mechanism 320 yields a result with a high level of quality.

The amount of target curl corresponding to the post-processing mechanism 320 may differ depending on, for example, the paper quality of the sheet. In such a case, the target curl determining unit 312 receives information indicating the paper quality of the input sheet and from the received information determines the amount of target curl corresponding to the sheet. In order to enable such a determination, the target curl determining unit 312 stores determination information 314 which is information forming a basis for determining the amount of target curl.

Figures 3, 4:
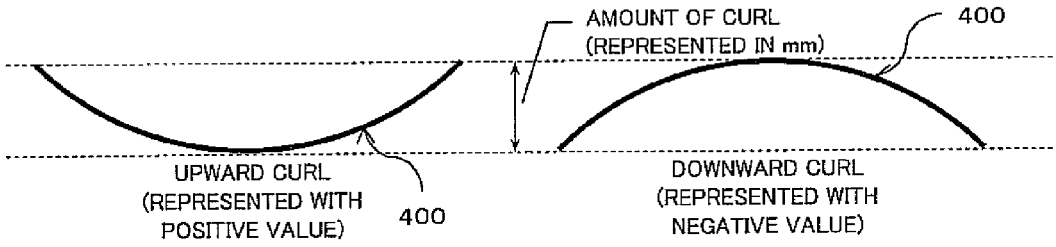
FIG. 3 is a diagram schematically showing an example of determination information for determining an amount of target curl.
FIG. 4 is a diagram for explaining an example representation form of an amount of curl.

FIG. 3 shows an example of the determination information 314 corresponding to a certain post-processing mechanism 320. In the illustrated example, the determination information 314 is a table in which a numerical value of the amount of target curl corresponding to paper quality is registered for each paper quality. The controller 310 maintains such determination information 314 for each post-processing mechanism 320 of the post-processing apparatus 300.

A representation form of the amount of curl in FIG. 3 will now be described with reference to FIG. 4. When a sheet 400 is transported with the surface being set horizontally, the curl of the sheet 400 may be categorized into an upward curl in which ends along the transport direction curl upward, and a downward curl in which the ends curl downward. In the illustrated example, the amount of curl for the upward curl is indicated with a positive value and the amount of curl for the downward curl is indicated with a negative value. A magnitude of the curl is represented with a difference in height between the center and ends of the sheet (in units of mm in the illustrated example).

Although determination information 314 in a form of a table is illustrated in FIG. 3, this is merely exemplary, and the determination information 314 may be information of a form other than a table. For example, the determination information 314 may be a program which outputs, when a value indicating the paper quality is input, a numerical value of the amount of target curl corresponding to the paper quality.

Moreover, although an example is described in which the amount of target curl is determined from the paper quality of the sheet, the amount of target curl may be determined in consideration of parameters other than the paper quality, such as the temperature and humidity. In this case, the determination information 314 is information for determining the amount of target curl corresponding to a combination of these parameter values.

The target curl determining unit 312 determines the amount of target curl from the determination information 314. The target curl notifying unit 316 transmits the determined amount of target curl to a target curl receiving unit 220 of the curl correction apparatus 200.

Next, the curl correction apparatus 200 will be described. The curl correction apparatus 200 has a controller 210 and a curl correction mechanism 230. The curl correction mechanism 230 is a mechanism for correcting a degree of curl of the printed sheet which is output from the image-forming apparatus 100. The mechanical structure of the curl correction-mechanism 230 may be similar to that in the related art.

The controller 210 is a unit which controls the curl correction apparatus 200. The controller 210 is realized, for example, by a processor such as a CPU executing a control program stored in a storage device (not shown). Alternatively, it is also possible to realize a part of the process for the control using a hardware circuit such as an ASIC.

The controller 210 receives information transmitted from the controller 120 of the image-forming apparatus 100 and controls the curl correction mechanism 230 in accordance with the received information. The controller 210 has an instruction acquiring unit 212, an initial curl determining unit 214, the instruction transmission unit 218, the target curl receiving unit 220, and a correction level determining unit 224.

The instruction acquiring unit 212 receives from the controller 120 of the image forming apparatus 100 instruction information including information which forms a basis for determination of a curl correction level. In the illustrated example of FIG. 2, the instruction information also includes information of an instruction to the post-processing apparatus 300. The instruction transmission unit 218 transmits the instruction information to the post-processing apparatus 300. Alternatively, in place of transmitting the instruction information itself to the post-processing apparatus 300, the instruction transmission unit 218 may transmit to the post-processing apparatus 300 only an instruction, in the instruction information, related to the post process.

The initial curl determining unit 214 determines an amount of curl of the sheet by the image-forming mechanism 130 (hereinafter referred to as "amount of initial curl") on the basis of instruction information received from the controller 120 of the image-forming apparatus 100. As is well known, the amount of curl of the sheet caused by the image-forming mechanism 130 depends on parameters such as, for example, the paper quality of the sheet, the area coverage on the sheet occupied by the image, and humidity, and, thus, the initial curl determining unit 214 determines the amount of initial curl on the basis of such parameters (curl characteristic information) included in the instruction information. For such a determination, the initial curl determining unit 214 has determination information 216. The determination information 216 is, for example, a table in which the value of the amount of curl is registered for each combination of the values of the above-described parameters, but is not limited to such a configuration. For example, the determination information 216 may alternatively be a program which outputs, when a combination of the parameters is input, an amount of curl corresponding to the combination. The initial curl determining unit 214 determines the amount of initial curl from the determination information 216. As the initial curl determining unit 214, structures known in the related art can be used, and, thus, the initial curl determining unit 214 will not be described in detail.

The parameters described above as parameters for determining the amount of initial curl such as the paper quality of the sheet, the area coverage of the image, and the humidity are merely exemplary, and other parameters may be considered, or only a part of the exemplified parameters may be used for determining the amount of initial curl. The controller 120 of the image-forming apparatus 100 may provide values of the parameters forming a basis for the initial curl determining unit 214 to determine the amount of initial curl.

The target curl receiving unit 220 receives information of the amount of target curl from the target curl notifying unit 316 of the post-processing apparatus 300.

The correction level determining unit 224 determines a curl correction level on the basis of the amount of initial curl determined by the initial curl determining unit 214 and the amount of target curl received by the target curl receiving unit 220. The curl correction level is a numerical value showing a direction of the curl correction and the degree of correction, and is supplied to the curl correction mechanism 230.

The curl correction mechanism 230 corrects the curl of the printed sheet which is input from the image-forming mechanism 130 in accordance with the curl correction level determined by the correction level determining unit 224. With this process, the amount of curl of the input sheet is set at the amount of target curl which is suitable for the post process performed by the post-processing mechanism 320. The sheet for which the curl is corrected is input to the post-processing mechanism 320.

Figure 5:
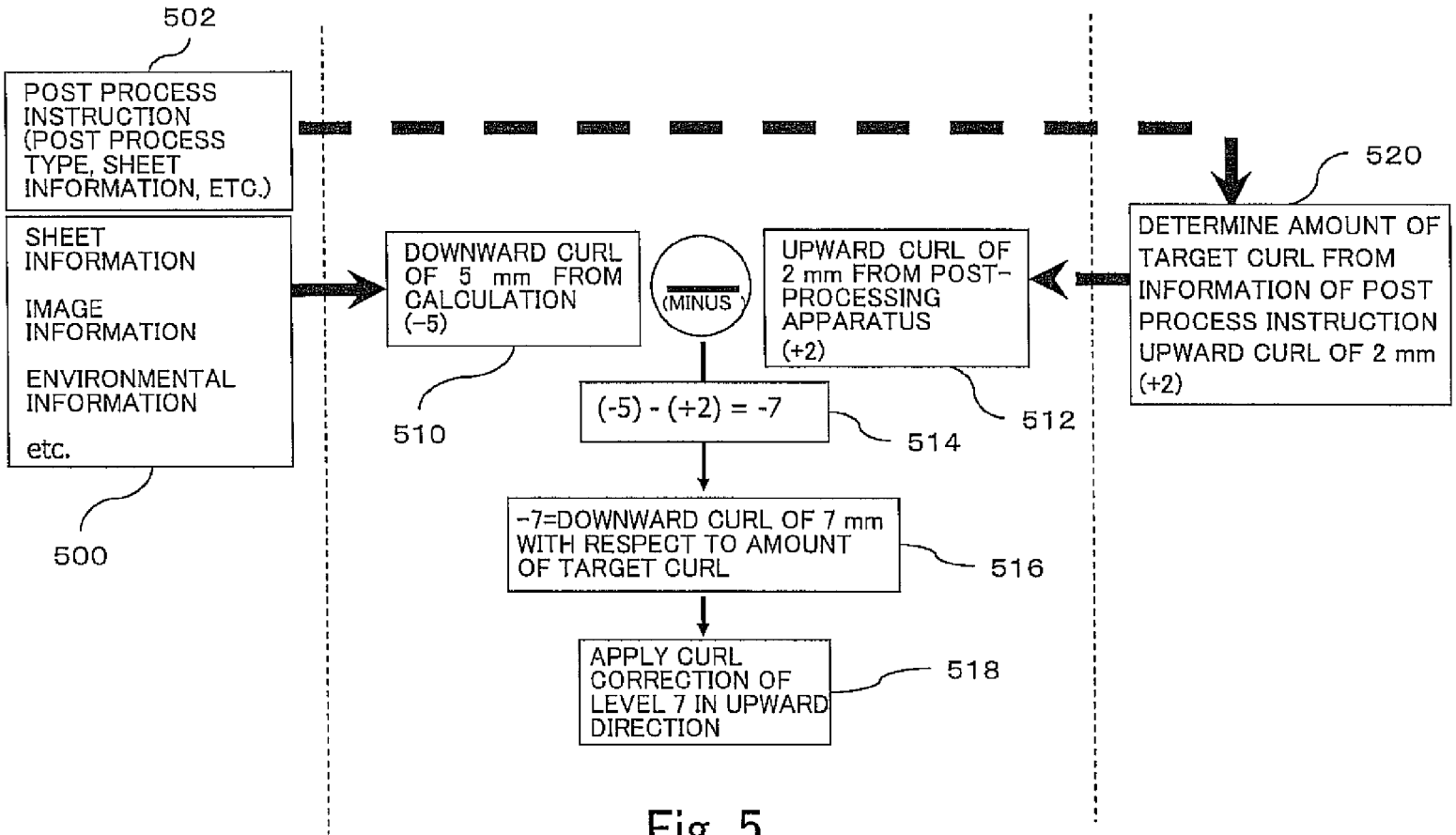
FIG. 5 is a diagram for explaining a flow of curl correction in an exemplary embodiment of the present invention.

Next, the determination process of the curl correction level in the correction level determining unit 224 will be described with reference to FIGS. 5 and 6. As shown in FIG. 5, when the image-forming apparatus 100 prints on a sheet, the image-forming apparatus 100 transmits to the curl correction apparatus 200, with regard to the printed sheet to be output, parameter information 500 which includes information related to the sheet such as the paper quality and size, information related to the image such as the image area coverage, and environmental information such as humidity. At the same time, the image-forming apparatus 100 transmits, to the post-processing apparatus 300, a post process instruction 502 including information for identifying a post-processing apparatus and a post-processing function to be used on the sheet and information related to the sheet such as the paper quality of the sheet.

At the post-processing apparatus 300, the target curl determining unit 312 determines an amount of target curl 520 corresponding to the sheet on the basis of the post process instruction 502 received from the curl correction apparatus 200. In the illustrated example, the amount of target curl is "+2". The determined amount of target curl 520 is transmitted by the target curl notifying unit 316 to the curl correction apparatus 200.

At the curl correction apparatus 200, the initial curl determining unit 214 determines an amount of initial curl 510 which is the amount of curl of the sheet which is output from the image-forming apparatus 100 on the basis of the parameter information received from the image-forming apparatus 100. In the illustrated example, the amount of initial curl 510 is "−5". In addition, the target curl receiving unit 220 receives the amount of target curl 512 (which, in the illustrated example, is +2) from the post-processing apparatus 300.

The correction level determining unit 224 subtracts the amount of target curl 512 received by the target curl receiving unit 220 from the amount of initial curl 510 determined by the initial curl determining unit 214 (block 514). The value determined by this subtraction indicates an amount of curl C of the sheet which is input from the image-forming apparatus 100 when the amount of target curl is taken as a reference. The calculation result of "−7" in the illustrated example indicates that the input sheet is curled downward by 7 mm with respect to the amount of target curl (block 516). Therefore, the correction level determining unit 224 determines a curl correction level for correcting the downward curl of 7 mm. As an example, the correction level determining unit 224 uses determination information as shown in FIG. 6. The determination information shown in FIG. 6 includes, for each range of the amount of curl C of the input sheet when the amount of target curl is taken as a reference, a pair consisting of a direction and a value of the curl correction level corresponding to the range. In the illustrated example, the curl correction level is represented by a combination of two directions consisting of positive (upward) and negative (downward), and a strength (level) of the correction of 10 scales from 1 to 10. Such a scaling is only exemplary. In the illustrated example of FIG. 5, it can be understood that, in order to correct the downward curl of 7 mm, curl correction must be applied in the upward direction with a strength of level 7. Using such determination information, the correction level determining unit 224 determines the curl correction level corresponding to the amount of curl C. The determination information of the curl correction level is not limited to the table format exemplified in FIG. 6. Alternatively, the determination information may be a program which calculates, when an amount of curl C is input, the curl correction level corresponding to the input amount of curl C. Alternatively, the curl correction level may be determined from a table in which a curl correction level is registered for each combination of the amount of initial curl and the amount of target curl.

Figure 7:
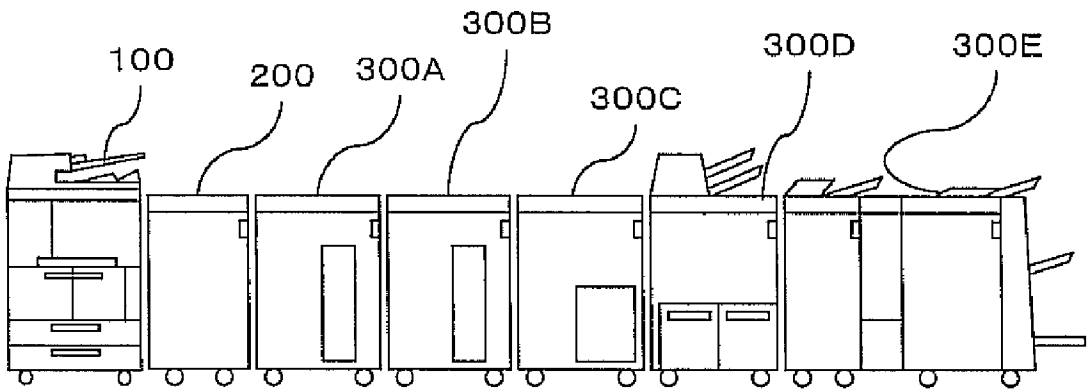
FIG. 7 is a side view showing an example system having multiple post-processing apparatuses.
Figure 8:
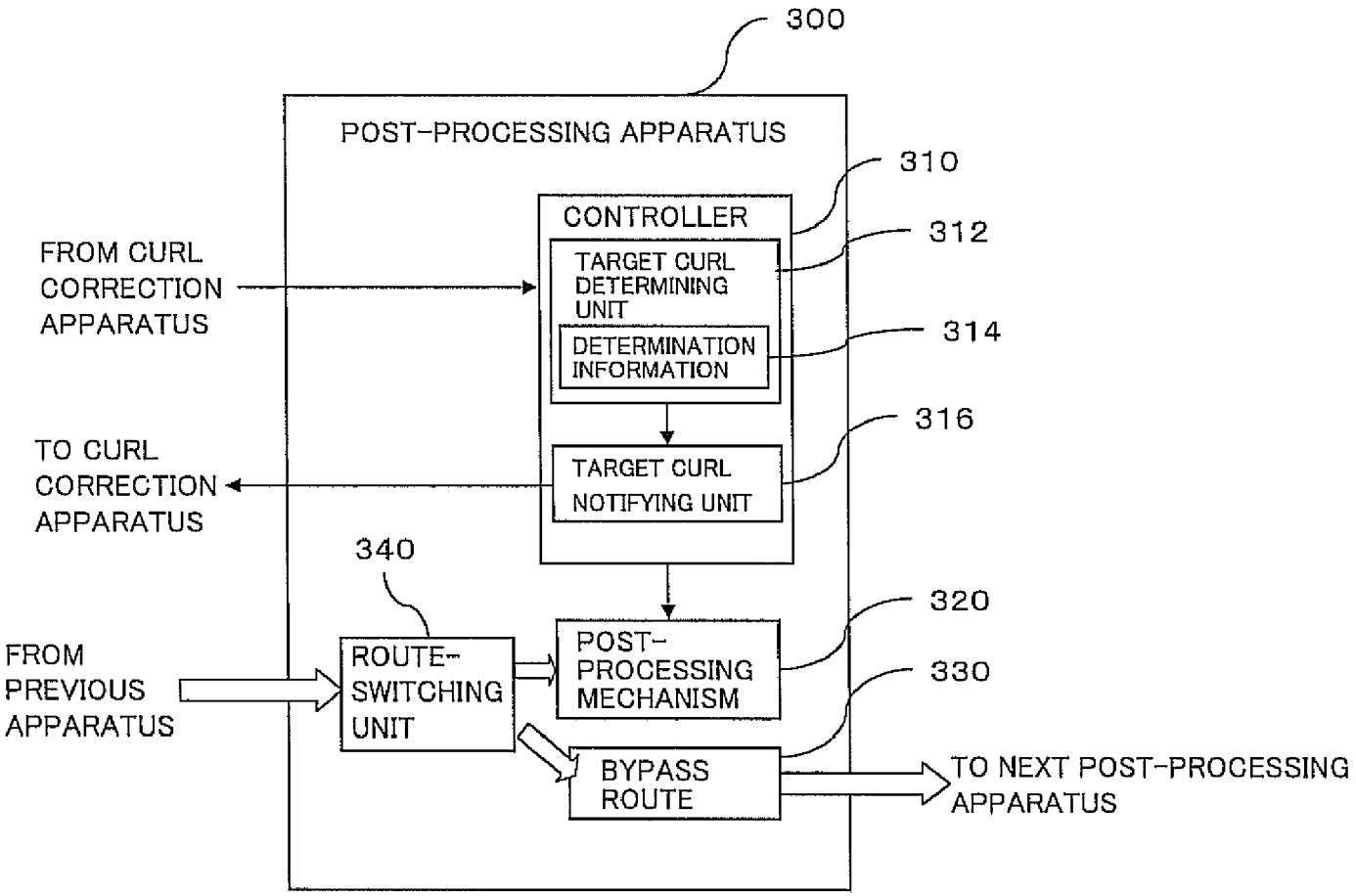
FIG. 8 is a diagram showing an example of a functional structure of an intermediate post-processing apparatus.

The image-forming system described above has only one post-processing apparatus 300. However, there exists a system having multiple post-processing apparatuses 300. For example, a system shown in FIG. 7 has, downstream of the curl correction apparatus 200, two stackers 300A and 300B, a tape binder 300C, a case binder 300D, and a multifunctional finisher 300E, connected in series in this order. The multifunctional finisher 300E is, for example, an apparatus in which multiple post-processing mechanisms are built in, such as a stapler and a folder. In such a system, as shown in FIG. 8, each of the post-processing apparatuses 300A-300D other than the post-processing apparatus 300E at the end has a bypass route 330 and a route-switching unit 340 in addition to the post-processing mechanism 320. An exit of the bypass route 330 is connected to a sheet entrance of the next post-processing apparatus 300. Each of the post-processing apparatuses 300A-300D sends, when a sheet on which the post-processing apparatus is not to perform the post process is input from an upstream apparatus (the curl correction apparatus 200 or the post-processing apparatus 300), the sheet to the bypass route 330 through the route switching unit 340. Because of this, the sheet is input to the next post-processing apparatus 300 via the bypass route 330 without being subjected to a process performed by the post-processing mechanism 320. In the illustrated system, the sheet is post-processed by one of the post-processing apparatuses 300A-300E. For example, when a print result is to be stacked, the printed sheet is stacked in the stacker 300A or 300B ("stacking" is an example of a post process). When a tape binding is to be applied, the printed sheet passes through the bypass routes 330 of the stackers 300A and 300B, reaches the tape binder 300C, and is bound by the tape binder 300C. The bound result is stacked at an output unit of the tape binder 300C.

Depending on the structure of the bypass route 330, the sheet transported along the bypass route 330 may be curled. Therefore, when a sheet which is output from the curl correction apparatus 200 passes through the bypass routes 330 of one or more post-processing apparatuses 300 (hereinafter referred to as "intermediate post-processing apparatus 300") before the sheet reaches the post-processing apparatus 300 which is to be used for the post process of the sheet (hereinafter referred to as "post-processing apparatus 300 to be used"), the sheet reaching the "post-processing apparatus to be used" 300 may be curled by the bypass routes 330.

A mechanism for curl correction in consideration of such a curl caused by the intermediate bypass routes 330 will now be described.

In the illustrated example, the post-processing apparatus 300 having the bypass route 330 has, as the determination information 314, determination information 314*a* for determining an amount of target curl of the post-processing mechanism 320 and determination information 314*b* for determining an amount of curl on the sheet caused by the bypass route 330, as shown in FIG. 9. In the illustrated example of FIG. 9, both determination information 314*a* and 314*b* are tables indicating a value of an amount of curl for each value of paper quality of the sheet, but this configuration is merely exemplary. The determination information 314*a* and 314*b* may consider parameters other than the paper quality (for example, paper size). The determination information 314*a* and 314*b* need not be tables, and may alternatively be, for example, a program which determines a value of the amount of curl corresponding to the parameter.

Figure 10:
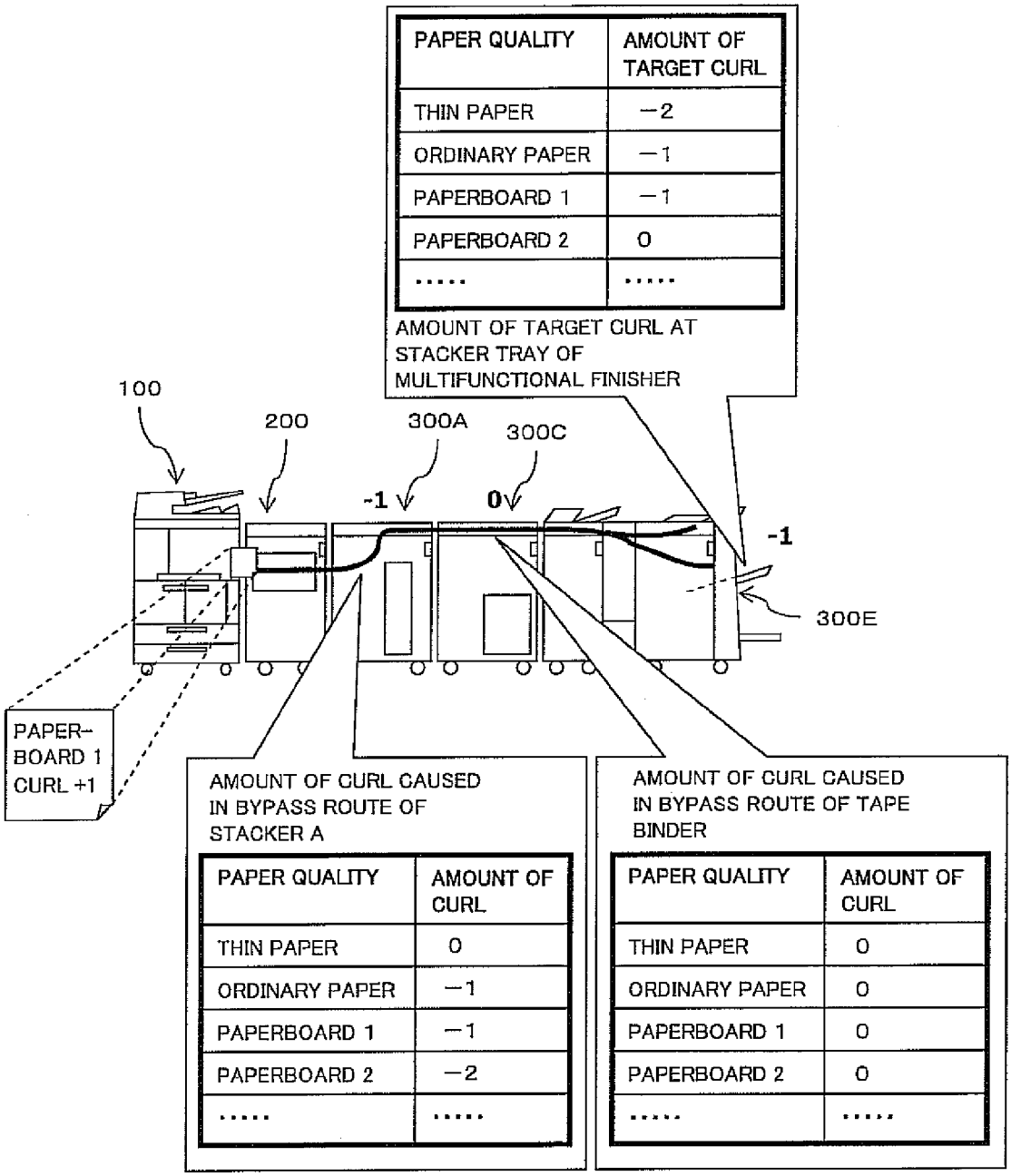
FIG. 10 is a diagram for explaining an example curl correction in a system having multiple post-processing apparatuses.

Next, a flow of a curl correction process in the illustrated example will be descried with reference to an example of FIG. 10. A system shown in FIG. 10 has, as the post-processing apparatuses, a stacker 300A, a tape binder 300C, and a multifunctional finisher 300E. In the following description, FIGS. 2 and 8 are referenced with regard to the internal structures of the image-forming apparatus 100, the curl correction apparatus 200, and the post-processing apparatus 300.

First, information of an instruction such as printing and information of an instruction related to the post process are input to the image-forming apparatus 100. These pieces of information may be input by the user through the UI unit 110 or may be input through the communication unit 125 in a form included in the print instruction from a client computer on the network. When the information of the instruction is received, the controller 120 of the image-forming apparatus 100 transmits to the curl correction apparatus 200 information of parameters such as the paper quality of the sheet used in the printing. The controller 120 also identifies, among multiple post-processing apparatuses 300, a post-processing apparatus 300 to be used for the post process of the sheet, on the basis of the received instruction of the post process, and transmits the instruction related to the post process to the "post-processing apparatus to be used" 300. In addition, the controller 120 transmits an instruction to select the bypass route 330 to the "intermediate post-processing apparatuses" 300 which are present between the curl correction apparatus 200 and the "post-processing apparatus to be used" 300. These instructions may be transmitted from the controller 120 directly to the post-processing apparatuses 300, or the curl correction apparatus 200 and the post-processing apparatuses 300 may relay the instructions to the next apparatus. In the illustrated example, the user instructs a post process to output the sheet to a stacker tray of the multifunctional finisher 300E. In this case, the multifunctional finisher 300E is the "post-processing apparatus to be used" and the stacker 300A and the tape binder 300C are the "intermediate post-processing apparatuses". Moreover, in the example, a configuration is exemplified in which the paper quality of the sheet selected by the user is "paperboard 1", and the amount of target curl of the post-processing mechanism 320 and the amount of curl of the bypass route 330 are determined on the basis of only the paper quality.

The controller 310 of the "post-processing apparatus to be used" 300 receiving the instruction controls the route-switching unit 340 to switch the route of the sheet to the post-processing mechanism 320. The controller 310 also determines an amount of target curl of the post-processing mechanism 320 on the basis of parameters included in the instruction, and transmits the amount of target curl to the curl correction apparatus 200. In the illustrated example of FIG. 10, the amount of target curl related to the stacker tray of the multifunction finisher 300E is "−1" for "paperboard 1".

In addition, the controller 310 of the "intermediate post-processing apparatus" 300 receiving the instruction controls the route-switching unit 340 to switch the route of the sheet to the bypass route 330. In addition, the controller 310 determines an amount of target curl corresponding to the bypass route 330 on the basis of the parameters included in the instruction, and transmits the amount of target curl to the curl correction apparatus 200. In the illustrated example of FIG. 10, the amount of curl of the bypass route 330 of the stacker 300A is "−1" for "paperboard 1", and the amount of curl of the bypass route 330 of the tape binder 300C is "0" for "paperboard 1".

The controller 210 of the curl correction apparatus 200 receiving the instruction determines an amount of initial curl caused by the image-forming mechanism 130. In the illustrated example of FIG. 10, the amount of initial curl is "+1". The controller 210 determines a curl correction level on the basis of the amount of initial curl, and the amounts of curl of the bypass routes 330 and the amount of target curl of the post-processing mechanism 320 which are received from the post-processing apparatuses 300A, 300C, and 300E. In other words, the controller 210 subtracts the amount of target curl from a sum of the amount of initial curl and the amounts of curl of the bypass routes 330, and on the basis of the determination information determines the curl correction level corresponding to the subtraction result. In the illustrated example of FIG. 10, the subtraction result is $\{(+1)+(-1)+0\}-(-1)=+1$. When the determination information of FIG. 6 is used, the curl correction level would be level 1 in the downward direction. The controller 210 controls the curl correction mechanism 230 to achieve this curl correction level.

The exemplary embodiment described above is merely exemplary. For example, because the amount of curl of the sheet is generally reduced as the distance to be transported is increased, the correction level determining unit 224 may determine the curl correction level in consideration of the transport distance from the curl correction apparatus 200 to the "post-processing apparatus to be used", in addition to the amount of initial curl and the amount of target curl. For this purpose, for example, determination information for determining an amount of level correction in accordance with the transport distance (for example, a table) may be registered in the curl correction apparatus 200, and the curl correction level determined from the amount of initial curl and the amount of target curl (and the amount of curl of the bypass route in some cases) may be corrected with an amount of level correction corresponding to the transport distance. By registering the transport distance to each post-processing apparatus 300 in the curl correction apparatus 200, it is possible to determine the transport distance to the "post-processing apparatus to be used" designated by the user.

In the above-described exemplary embodiment, the amount of target curl (and amount of bypass curl) is notified from the post-processing apparatus 300 to the curl correction apparatus 200 for each sheet, but this is only exemplary. Alternatively, it is also possible to notify the amount of target curl (and amount of bypass curl) for each job (that is, an image-forming process for one to multiple sheets executed in accordance with an instruction by the user) instead of each sheet. For example, because typically the same type of sheet is used in one job, if the parameters for determining the amount of target curl (and amount of curl of the bypass route 330) are only those related to the sheet, the notification may be for each job.

In addition, in the above-described exemplary embodiment, the post-processing apparatus 300 determines the amount of target curl (and amount of curl of the bypass route 330) and notifies the amount of target curl to the curl correction apparatus 200, but this is only exemplary. Alternatively, it is also possible to employ a configuration in which each post-processing apparatus 300 transmits the determination information 314 of the post-processing apparatus 300 to the curl correction apparatus 200, and the curl correction apparatus 200 determines the amount of target curl or the like on the basis of the received determination information. The transmission may be executed, for example, in an initialization routine of each post-processing apparatus 300 when the image-forming system is powered on.

Moreover, in the above-described exemplified embodiment, the curl correction apparatus 200 determines the curl correction level. Alternatively, the process for the determination may be executed by the image-forming apparatus 100 and the curl correction apparatus 200 may be controlled in accordance with the determined curl correction level.

Furthermore, in the above-described exemplary embodiment, the image-forming apparatus 100 and the curl correction apparatus 200 are constructed as separated apparatuses. Alternatively, the image-forming apparatus 100 may include the curl correction mechanism 230. In this case, the controller 120 executes the determination process of the curl correction level.

Figure 11:
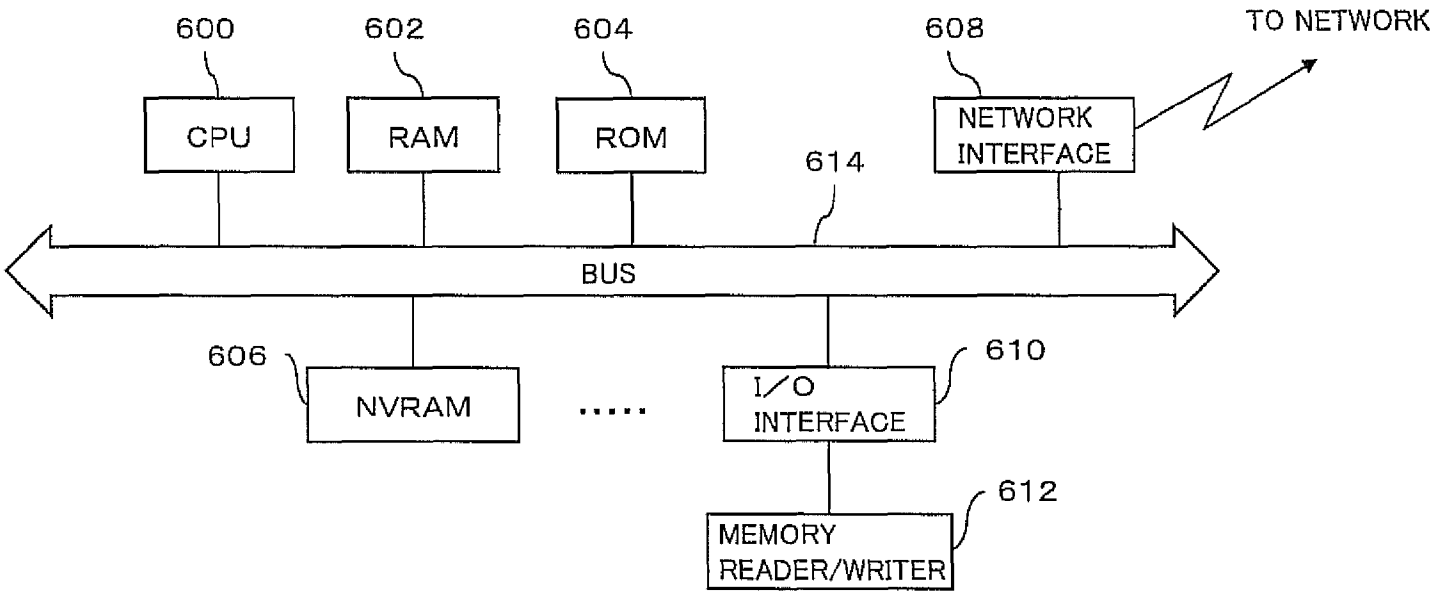
FIG. 11 is a diagram showing an example hardware structure of a computer.

The controllers 120 and 210 of the above-described exemplary embodiment may be constructed as a hardware circuit such as an ASIC or FPGA (Field Programmable Gate Array), as software, or as a combination of a hardware circuit and software. When the controller is realized as software, a computer may execute a program which describes the function or process content of each unit described above. As shown in FIG. 11, the computer may have, as hardware, a circuit structure in which a microprocessor such as a CPU 600, a memory (primary storage) such as a random access memory (RAM) 602 and a read-only memory (ROM) 604, a nonvolatile RAM (NVRAM) 606, a network interface 608 which controls a connection with a network such as a local area network, various I/O (input/output) interfaces 610, etc., are connected via a bus 614. A memory reader/writer 612 for reading and/or writing from and/or to transportable nonvolatile recording media of various standards such as a flash memory or a transportable computer may be connected, for example, through the I/O interface 610 to the bus 614. The program for realizing the functions of the above-described exemplary embodiment may be stored in the ROM 604. Alternatively, such a program may be installed from a transportable memory device or computer through the I/O interface 610 to the NVRAM 606. Alternatively, such a program may be downloaded from a host computer on a network through the network interface 608 and installed in the NVRAM 606. The processes of the exemplary embodiment are realized by the microprocessor such as the CPU 600 executing the program in the ROM 604 or NVRAM 606. When the image-forming apparatus 100 or the curl correction apparatus 200 has a hard disk drive, the program may be installed in the hard disk drive. The processes of the exemplary embodiment may be realized when the program stored in the hard disk is read into the RAM 602 and the microprocessor executes the program.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with various modifications as are suited to the particular use contemplated. It is intended that the scope of the invention be defined by the following claims and their equivalents.

What is claimed is:

1. An image-forming system comprising:

an image-forming apparatus;

a paper curl correction apparatus that corrects a curl of a sheet which is input from the image-forming apparatus; and one or more post-processing apparatuses connected downstream of the paper curl correction apparatus, the one or more post-processing apparatuses comprising one or more post-processing units that perform a post process on the sheet;

an identifying unit that identifies on the basis of an input post process instruction, a post-processing apparatus to be used among the one or more post-processing apparatuses, and further a post-processing apparatus identified to be used; and transmits, to the post-processing identified to be used, an instruction to perform the post process by the post-processing unit identified to be used, wherein each of the post-processing apparatuses comprises:

a target curl information storage unit that stores for each of the one or more post-processing units, target curl information for determining an amount of curl of a sheet suited for the post-processing unit, a first provision unit that acquires, in response to a query from the paper curl correction apparatus for target curl information corresponding to the post-processing unit identified to be used by the identifying unit, the target curl information corresponding to the post-processing unit identified to be used and provides the acquired target curl information to the paper curl correction apparatus; and the paper curl correction apparatus comprises:

an input curl determining unit that determines, from curl characteristic information of the image-forming apparatus, input curl information corresponding to an amount of curl of a sheet which is input from the image-forming apparatus;

a target curl acquiring unit that sends a query to the post-processing apparatus identified to be used by the identifying unit, for target curl information corresponding to the post processing unit identified to be used by the identifying unit, and acquires the target curl information provided by the post-processing apparatus to be used in response to the query;

a correction determining unit that determines, from input curl information determined by the input curl determining unit and the target curl information acquired by the target curl acquiring unit, an amount of curl correction for correcting an amount of curl of the sheet which is input from the image-forming apparatus to an amount of curl suited for the post-processing unit to be used;

a first controller that receives the amount of curl correction associated with each of the one or more post-processing apparatuses and routes the curl correction to the appropriate post-processing apparatus or transmits an instruction to select a bypass route to one or more intermediate post-processing apparatuses that are present between the paper curl correction apparatus and the one or more post-processing apparatuses; and a curl correcting unit that corrects a curl of a sheet which is input from the image-forming apparatus in accordance with the amount of curl correction determined by the correction determining unit provided by the controller associated with the post-processing apparatus.

2. The image-forming system according to claim 1, wherein the one or more post-processing apparatuses are connected in series downstream of the paper curl correction apparatus, the identifying unit instructs passage of the sheet for an intermediate post-processing apparatus, among the one or more post-processing apparatuses, positioned between the paper curl correction apparatus and the post-processing apparatus to be used, each of the post-processing apparatuses further comprises:

a passing unit that allows the sheet which is input from an upstream apparatus to pass to a downstream post-processing apparatus without passing through the post-processing unit;

a second controller that applies a control to input, when execution of a post process by the post-processing unit identified to be used by the identifying unit is instructed, the sheet which is input from an upstream apparatus to the post-processing unit identified to be used and to input, when a passage of the sheet is instructed by the identifying unit, the sheet which is input from the upstream apparatus to the passing unit; and a second provision unit that provides, to the paper curl correction apparatus, passage curl information for determining an amount of curl of a sheet which arises on a sheet passing through the passing unit, and the correction determining unit of the paper curl correction apparatus determines the amount of curl correction from the input curl information determined by the input curl determining unit, the target curl information corresponding to the post-processing unit identified to be used by the identifying unit, and the passage curl information of each of the intermediate post-processing apparatuses so that the amount of curl of the sheet which is input from the image-forming apparatus is an amount of curl suited for the identified post-processing unit.

3. The image-forming system according to claim 1, wherein the correction determining unit comprises a correcting unit that corrects the amount of curl correction in accordance with a sheet transport distance from the paper curl correction apparatus to the post-processing unit to be used.

4. The image-forming system according to claim 1, wherein the correction determining unit subtracts the input curl information from the target curl information to determine the amount of curl correction.

5. A paper curl correction apparatus comprising:

an input curl determining unit that determines, on the basis of curl characteristic information of a first apparatus which processes a sheet, input curl information corresponding to an amount of curl of a sheet which is input from the first apparatus;

a target curl acquiring unit that sends, to a post-processing apparatus identified to be used for a post-process of a sheet among a plurality of post-processing apparatuses, a query for target curl information for determining an amount of curl of a sheet suited for the post-process, and acquires the target curl information provided from the post-processing apparatus identified to be used in response to the query;

a correction determining unit that determines, on the basis of input curl information determined by the input curl determining unit and target curl information acquired by the target curl acquiring unit, an amount of curl correction for correcting an amount of curl of the sheet which is input from the first apparatus to an amount of curl suited for the post process;

a first controller that receives the amount of curl correction associated with each of the post-processing apparatuses and routes the curl correction to the post-processing apparatus or transmits an instruction to select a bypass route to one or more intermediate post-processing apparatuses that are present between the paper curl correction apparatus and the post-processing apparatuses; and a curl correcting unit that corrects the curl of the sheet which is input from the first apparatus in accordance with an amount of curl correction determined by the correction determining unit.

6. The paper curl correction apparatus according to claim 5, further comprising:

a passage curl acquiring unit that acquires, from each intermediate apparatus through which the sheet which is output from the paper curl correction apparatus passes before reaching the post-processing apparatus, passage curl information for determining an amount of curl caused on the paper passing through the intermediate apparatus, wherein the correction determining unit determines the amount of curl correction from the input curl information determined by the input curl determining unit, the target curl information acquired by the target curl acquiring unit, and passage curl information of each intermediate apparatus acquired by the passage curl acquiring unit.

7. The paper curl correction apparatus according to claim 5, wherein the correction determining unit subtracts the input curl information from the target curl information to determine the amount of curl correction.

8. An image-forming apparatus comprising:

an image-forming unit that forms an image on a sheet;

an input curl determining unit that determines input curl information corresponding to an amount of curl of a sheet which is input from the image-forming unit, from curl characteristic information of the image-forming unit;

a target curl acquiring unit that sends, to a post-processing apparatus identified to be used for a post-process of the sheet among a plurality of post-processing apparatuses, a query for target curl information for determining an amount of curl of a sheet suited for the post-process, and acquires the target curl information provided from the post-processing apparatus identified to be used in response to the query;

a correction determining unit that determines, on the basis of input curl information determined by the input curl determining unit and target curl information acquired by the target curl acquiring unit, an amount of curl correction for correcting an amount of curl of a sheet which is input from the image-forming unit to an amount of curl suited for the post process; and a first controller that receives the amount of curl correction associated with each of the post-processing apparatuses and routes the curl correction to the post-processing apparatus or transmits an instruction to select a bypass route to one or more intermediate post-processing apparatuses that are present between a paper curl correction apparatus and the post-processing apparatuses.

9. The image-forming apparatus according to claim 8, further comprising:

a passage curl acquiring unit that acquires, from each intermediate apparatus through which the sheet which is output from the paper curl correction apparatus passes before reaching the post-processing apparatus, passage curl information for determining an amount of curl caused on the sheet passing through the intermediate apparatus, wherein the correction determining unit determines the amount of curl correction on the basis of the input curl information determined by the input curl determining unit, the target curl information acquired by the target curl acquiring unit, and the passage curl information of each intermediate apparatus acquired by the passage curl acquiring unit.

10. The image-forming apparatus according to claim 8, wherein the correction determining unit subtracts the input curl information from the target curl information to determine the amount of curl correction.

11. A post-processing apparatus comprising:

one or more post-processing units that perform a post process on a sheet; and a target curl information storage unit that stores for each of the one or more post-processing units, target curl information for determining an amount of curl of a sheet suited for the post-processing unit; and a first provision unit that acquires, in response to a query from the paper curl correction apparatus for target curl information corresponding to the post-processing unit identified to be used by the identifying unit, the target curl information corresponding to the post-processing unit identified to be used and provides the acquired target curl information to the paper curl correction apparatus; and a first controller that receives the amount of curl correction associated with each of the one or more post-processing units and routes the curl correction to a post-processing unit or transmits an instruction to select a bypass route to one or more intermediate post-processing units that are present between a paper curl correction apparatus and the post-processing apparatuses.

12. The post-processing apparatus according to claim 11, further comprising:

a passing unit that allows a sheet which is input from an upstream apparatus to pass to a downstream post-processing apparatus without passing through the post-processing unit;

a second controller that applies a control to input, when execution of a post process is instructed, the sheet which is input from the upstream apparatus to the post-processing unit corresponding to the designated post process, and to input, when passage of the sheet is instructed, the sheet which is input from the upstream apparatus to the passing unit; and a second provision unit that provides to the paper curl correction apparatus passage curl information for determining an amount of curl of sheet caused on a sheet which passes through the passing unit.

13. The post-processing apparatus according to claim 11, wherein the correction determining unit subtracts the input curl information from the target curl information to determine the amount of curl correction.

14. A non-transitory computer-readable medium storing a program which, when executed, causes a computer to control paper curl correction, the program causing the computer to function as:

an input curl determining unit that determines, from curl characteristic information of an image-forming apparatus which forms an image on a sheet, input curl information corresponding to an amount of curl of a sheet which is input from the image-forming apparatus;

a target curl acquiring unit that acquires sends, to a post-processing apparatus identified to be used for a post-process of a sheet among a plurality of post-processing apparatuses, a query for target curl information for determining an amount of curl of a sheet suited for the post-process, and acquires the target curl information provided from the post-processing apparatus identified to be used in response to the query;

a correction determining unit that determines, from input curl information determined by the input curl determining unit and target curl information acquired by the target curl acquiring unit, an amount of curl correction for correcting an amount of curl of the sheet which is input from the image-forming apparatus to an amount of curl suited for the post process; and a first controller that receives the amount of curl correction associated with each of the post-processing apparatuses and routes the curl correction to the post-processing apparatus or transmits an instruction to select a bypass route to one or more intermediate post-processing apparatuses that are present between a paper curl correction apparatus and the post-processing apparatuses.

15. The non-transitory computer-readable medium according to claim 14, wherein the correction determining unit subtracts the input curl information from the target curl information to determine the amount of curl correction.

* * * * *